US007703258B2

(12) United States Patent
LaLonde et al.

(10) Patent No.: US 7,703,258 B2
(45) Date of Patent: Apr. 27, 2010

(54) MAIN TEE CONNECTION

(75) Inventors: Paul D. LaLonde, Highland Park, IL (US); James J. Lehane, McHenry, IL (US); Daniel J. Coyne, Lodi, CA (US)

(73) Assignee: USG Interiors, Inc., Chicago, IL (US)

( * ) Notice: Subject to any disclaimer, the term of this patent is extended or adjusted under 35 U.S.C. 154(b) by 930 days.

(21) Appl. No.: 11/135,058

(22) Filed: May 23, 2005

(65) Prior Publication Data

US 2006/0260246 A1 Nov. 23, 2006

(51) Int. Cl.
*E04C 3/00* (2006.01)
*E04B 9/00* (2006.01)

(52) U.S. Cl. ..... 52/848; 52/506.07; 403/300

(58) Field of Classification Search ..... 52/506.07, 52/733.1, 726.1, 726.2, 848; 403/300
See application file for complete search history.

(56) References Cited

U.S. PATENT DOCUMENTS 3,221,466 A * 12/1965 Downing, Jr. et al. ..... 52/848
3,565,474 A * 2/1971 Stumbo et al. ..... 403/219
3,898,784 A * 8/1975 Sauer et al. ..... 403/327
3,928,950 A * 12/1975 Beynon ..... 52/506.07
4,108,563 A * 8/1978 Brown et al. ..... 403/347
4,161,856 A * 7/1979 Brown et al. ..... 52/667
4,314,432 A * 2/1982 Rosenbaum ..... 52/506.07
4,317,641 A * 3/1982 Sauer ..... 403/347
4,389,828 A * 6/1983 Cary ..... 52/665
4,531,340 A 7/1985 Sauer
4,601,153 A * 7/1986 Dunn et al. ..... 52/666
4,648,230 A * 3/1987 Mieyal et al. ..... 52/667
4,912,894 A 4/1990 Platt
4,989,387 A * 2/1991 Vukmanic et al. ..... 52/667
5,216,865 A 6/1993 LaLonde et al.
5,271,202 A * 12/1993 Vukmanic et al. ..... 52/667
5,761,868 A 6/1998 LaLonde et al.
5,839,246 A * 11/1998 Ziegler et al. ..... 52/506.07
6,041,564 A * 3/2000 Shirey ..... 52/506.07
6,178,712 B1 * 1/2001 Sauer ..... 52/506.07
6,305,139 B1 10/2001 Sauer
6,523,313 B2 * 2/2003 Platt et al. ..... 52/506.06
6,729,100 B2 * 5/2004 Koski et al. ..... 52/726.2

* cited by examiner

*Primary Examiner*—Richard E Chilcot, Jr.
*Assistant Examiner*—Brent W Herring
(74) *Attorney, Agent, or Firm*—Pearne & Gordon LLP

(57) ABSTRACT

A main tee with separate clips affixed on its ends for splicing the tee with identical tees in end-to-end butt joints. The tee and clip form a pocket for receiving the projecting end of an opposing clip with a uniform low insertion force. The clip is self-aligning with the pocket and when interconnected the clips precisely align the coupled tees both vertically and horizontally. The clips, formed of relatively strong material, have mutually engageable locking surfaces that ensure a strong joint.

14 Claims, 5 Drawing Sheets

MAIN TEE CONNECTION

BACKGROUND OF THE INVENTION

The invention relates to suspended ceiling grid and more particularly, to improvements in splice connections for main runners for such systems.

PRIOR ART

Suspended ceiling grid customarily comprises main runners and cross runners that intersect the main runners. The main runners are produced in fixed lengths, typically in 12 foot lengths, and are spliced end-to-end to extend across a room. For connecting their ends, current grid tee or runner products commonly utilize an integral splice or connector cut and formed from the grid runner web material. The splice uses a lanced pocket pushed out from the vertical web plane in one direction and a protruding stiffened tongue with a locking detent pushed out in the opposite direction. Upon installation, the tongue of each runner or tee inserts into an opposing pocket making a double lock. When all of the physical features of the splice are formed in the ideal or desired configuration and location, the tees interlock with a light predictable insertion pressure, aligned both vertically and horizontally with each other. The resultant connection adequately resists pull-apart forces. The geometry of various physical features, however, tends to vary positionally with variations or change in material thickness of the tee material requiring repeated tooling adjustments as necessary to achieve acceptable part function. Complaints of hard splice assembly and face misalignment are the result of compromise in ordinary variation in the supply of material, tool wear, and sometimes a lack of constant vigilance at the point of manufacture.

SUMMARY OF THE INVENTION

The invention provides a splice connection for main runners or tees comprising an end assembly with a uniquely formed pocket made in a cavity between the central web of the runner and a separate spring steel clip attached to the web to align and interlock with an identical opposed end assembly. The result is an in-line connection for main runners or tees. Because the disclosed pocket is formed by the cavity created between an embossed recess on one side of the tee web and an inside clip surface, the pocket can be made with a fixed width, regardless of variations in material thickness of the tee itself. The disclosed concept enables a connection to exhibit consistent insertion pressure as a result of the fixed geometry of the tee cavity and the resilient nature of the clip and web assembly.

The disclosed clip is configured to connect directly with an identical clip so that a reliable high strength joint is produced independent of any variation in the properties of the material of the tee. The clip and pocket are configured to initially self-align the ends of the runners being joined and, when finally connected, to accurately register the butted ends of the runners.

DESCRIPTION OF THE PREFERRED EMBODIMENT

Figure 1:
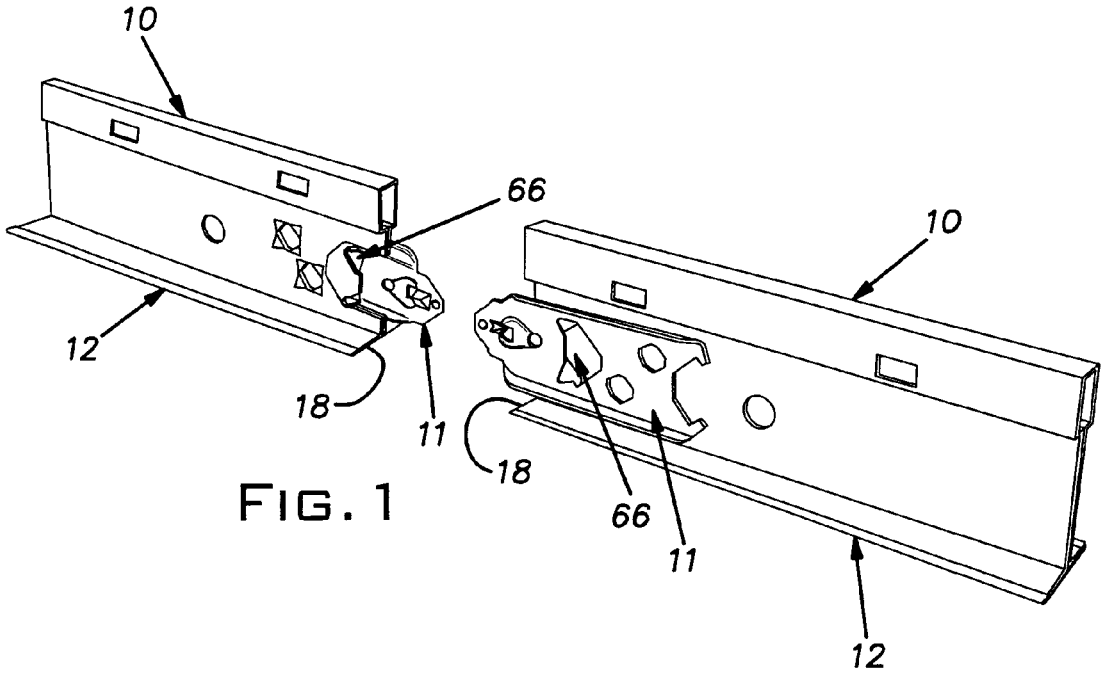
FIG. 1 is a fragmentary perspective view of the ends of two grid runners prior to being joined.
Figure 9:
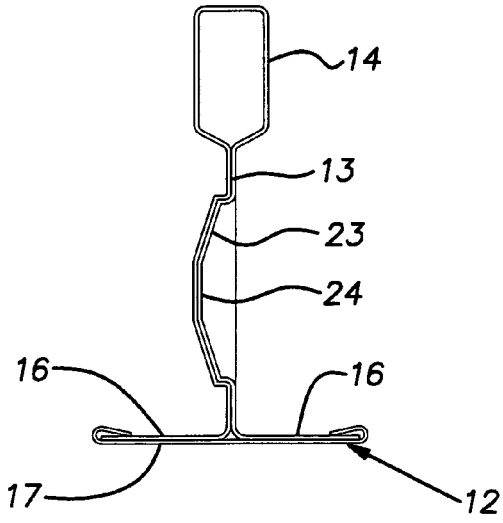
FIG. 9 is an end elevational view of the grid runner of FIG. 7.

A main runner or grid tee 10 is assembled at each of its longitudinal ends with a connector clip 11. The illustrated grid tees 10 are generally conventional in construction having a lower flange 12, a web 13 extending vertically upwardly from the center of the flange, and a hollow reinforcing bulb 14 at the upper edge of the web. In a conventional manner, the tee 10 can be made by roll forming continuous strips of mild steel sheet stock so that the bulb 14 has a single wall and the web 13 is formed by two layers of sheet stock and the flange 12 has two portions 16. The flange portions 16 are retained together and concealed from a view below by a cap strip 17 of sheet metal, as is conventional. The roll formed stock is cut into tees of predetermined length, for example, nominally 12 feet. The opposite ends of the tees are cut so that its edges 18 at the flange 12 are perpendicular to the longitudinal direction of the tee and the edges of the web 13 and bulb 14 can be formed in a plane tilted slightly rearwardly (e.g. 1 to 3 degrees) away from a vertical plane through the flange edge 18. This slight rearward tilt assures that upon assembly with a mating tee, the respective flange edges 18 will form a tight butt joint for a good appearance. When describing the tees 10 and clips 11 herein, the forward direction is a direction away from the center of a tee and, when reference is made to a standard tee, the flanges 12 are, as mentioned, at the lower edge of the vertical web consistent with the orientation of the tee in a normal installed condition.

Each end of a tee 10 has its web 13 pierced with a notch 21 open at an edge 22 of the web. Rearward of the web edge 22, a portion of the web 13 is formed or stamped with a lateral offset or embossment 23 that includes a cantilever tab 24. The tab 24 is free of connection with surrounding areas of the web in a zone forward of its connection with the remainder of the embossment 23. Apart from the embossment 23, including the tab 24, the material of the web 13 surrounding the notch 21 remains in the original plane of the web 13. Lower and upper edges 26, 27 of the notch 21 are spaced from the flange portion 16 and bulb 14 a substantial distance preferably, for example, a distance at least several times the thickness of the stock forming the tee thereby enabling the tooling that creates the notch to be robust in this area for long tool life. Two holes 28 are punched through the web 13 to receive parts of the clip 11 for their permanent assembly as described below.

The clip 11 is stamped from sheet metal stock preferably in strip form processed in progressive dies or tooling in which various features or formations are made on the clip body. The clip 11, preferably, is formed of a high strength spring steel such as Martinsite −130 having a thickness by way of example of 0.020 inch. The clip material is thus substantially harder than the mild steel material of the tee 10.

The clip 11 has an elongated form with an inner face 31 adapted to abut the web 13 and an opposite outer face 32. The clip 11 includes stiffening or reinforcing flanges 33, 34 at its top and bottom edges projecting outwardly from the outer face 32. The clip 11 is lanced and formed at two locations 36 to form integral projections 37 that after being inserted in corresponding holes 28 in the tee web 13 are staked or clinched in the manner of a rivet to permanently assemble the clip 11 to the grid tee 10. The areas of the clip 11 surrounding the projections 37 is planar and, for reference purposes can be considered to be the plane of the clip body or clip proper. Apart from the projections 37, the clip 11 is bilaterally symmetrical about a longitudinal medial plane.

Figure 2:
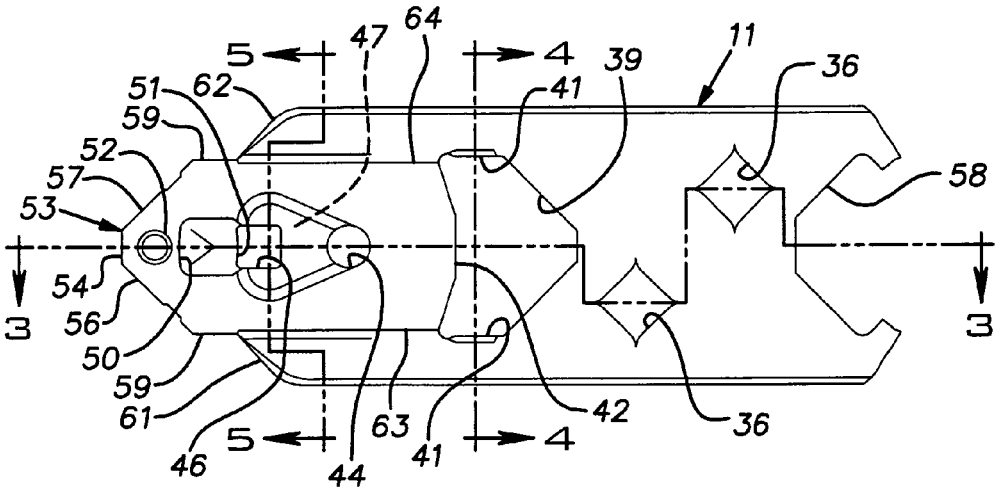
FIG. 2 is a side elevational view of an end clip embodying the invention.
Figure 4:
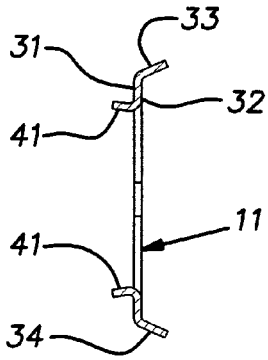
FIG. 4 is a cross-sectional view of the clip taken in a vertical plane 4-4 indicated in FIG. 2.
Figure 5:
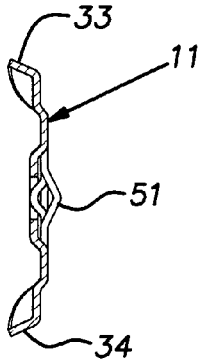
FIG. 5 is a cross-sectional view of the clip taken in the staggered planes indicated by the lines 5-5 in FIG. 2.

A central major polygonal or chevron-shaped hole 39 through the clip 11 has at its upper and lower regions, a pair of opposed flanges 41 bent out of the plane of the clip. The flanges or tabs 41 as seen in FIG. 4 are bent out of the clip plane by more than 90 degrees so that they converge towards one another with increasing proximity to the plane of the clip. On its forward side, the hole 39 is bounded by a rearwardly facing edge surface 42. Forward of the major hole 39, in succession, are a minor round hole 44 and a square hole 46. The round hole 44 is centered on an imaginary vertical line through the end edge 18 of a runner flange when the clip is assembled on the runner. A triangular depression 47 formed in the inner face or side 31 of the clip opposite the side seen in FIG. 2 bridges the area between the minor holes 44, 46. A lateral projection 48, centered on the imaginary center line or medial plane of a clip 11 is formed on the clip inner face forward of the square hole 46. The projection 48 has a cam surface 49 that tapers laterally away from surrounding areas of the clip from a forward portion 50 rearwardly to a rearwardly facing locking edge surface 51 that forms part of the hole 46. A small spherical projection 52 is formed on the outer side of the clip 11 longitudinally between the projection 48 and a lead edge 53 of the clip 11. The lead edge 53 has a vertical portion 54 and lower and upper inclined portions 56, 57, respectively, trailing the vertical portion 54.

Figure 6:
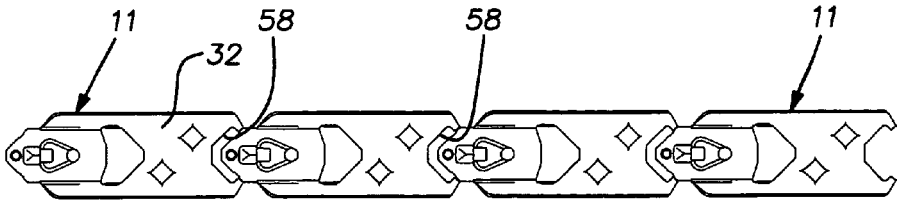
FIG. 6 is a showing of the clip of the invention after being progressively stamped but prior to being separated from a continuous strip of successively stamped clips.
Figure 8:
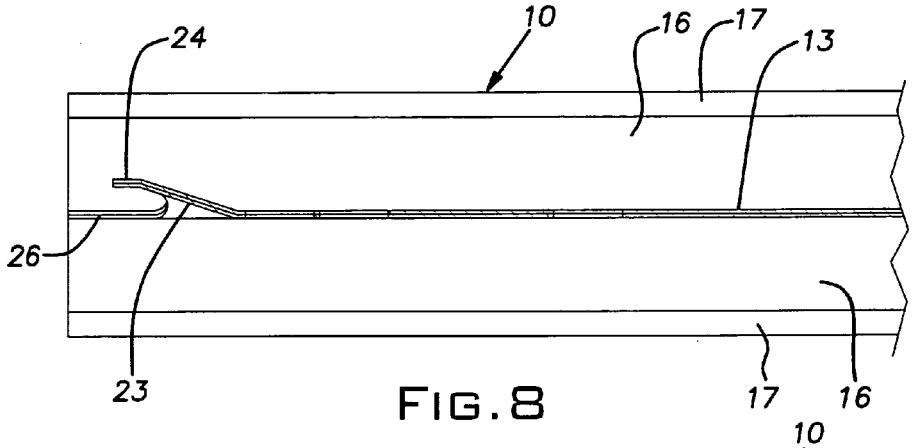
FIG. 8 is a cross-sectional view of the web of the grid runner of FIG. 7 taken in the staggered plane indicated by the lines 8-8.
Figure 7:
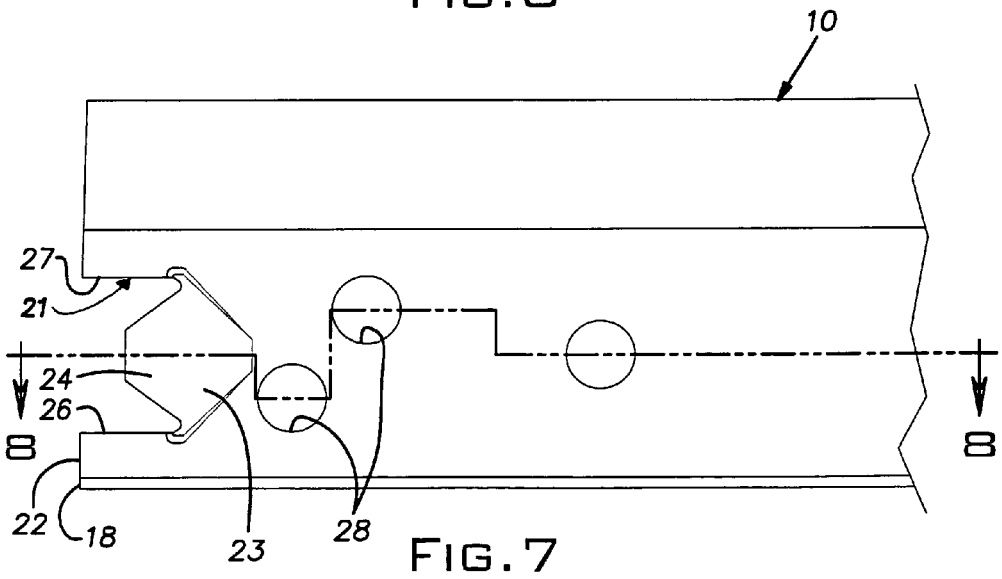
FIG. 7 is a side elevational view of an end portion of a grid runner.
Figure 10:
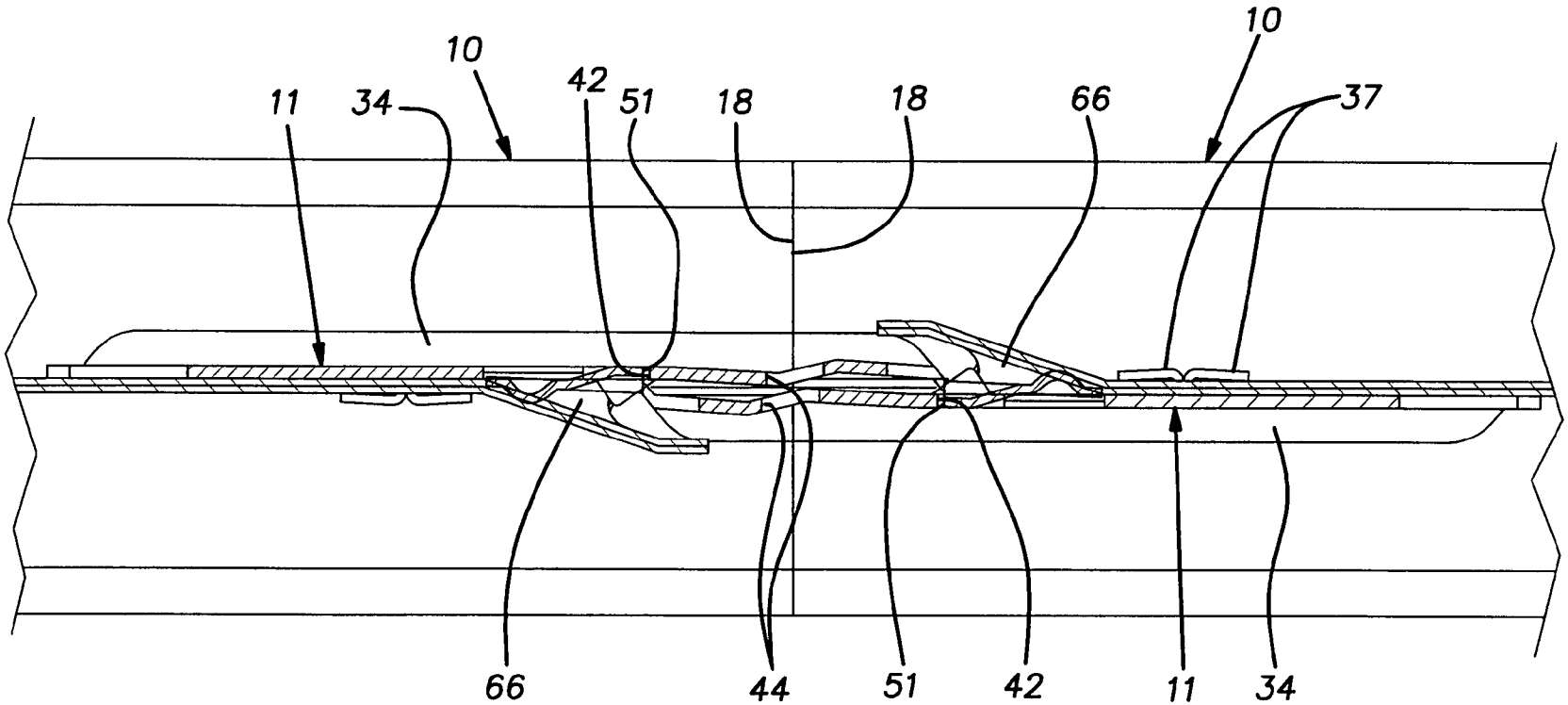
FIG. 10 is a cross-sectional view taken in a horizontal plane of the end portions of a pair of butted grid runners and associated coupled connector clips.

FIG. 6 shows that the forward tapered end of a clip bounded by the lead edge portions 54, 56, 57 nests within a V-shaped notch 58 pierced in a rearward part of a preceding clip made in progressive stamping equipment. This technique produces a clip 11 that is considerably longer than the effective length of stock used per clip. The extended length of the clip 11 enhances its stability when assembled on the tee 10.

The lead edge portions 56, 57 extend to horizontal edges 59 spaced a predetermined distance from one another. Rearward of the horizontal edges 59, are inclined surfaces 61, 62 formed by extensions of the clip flanges 33, 34.

Figure 3:
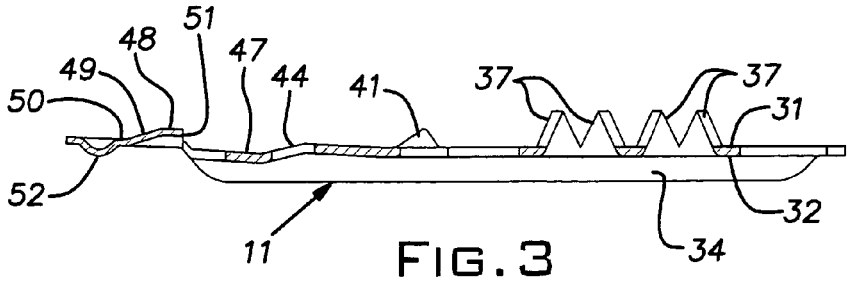
FIG. 3 is a longitudinal cross-sectional view of the clip taken in the plane 3-3 indicated in FIG. 2.

The body of the clip 11 forward of the major hole 39 between horizontal bend lines indicated at 63, 64, extended from the edge portions 59 and surrounding the projections 52 and 48 and recess or depression 47, is planar and bent slightly laterally, from the plane of the clip body rearward of the major hole 39, to the side to which the projection 48 extends (FIG. 3).

Figure 11:
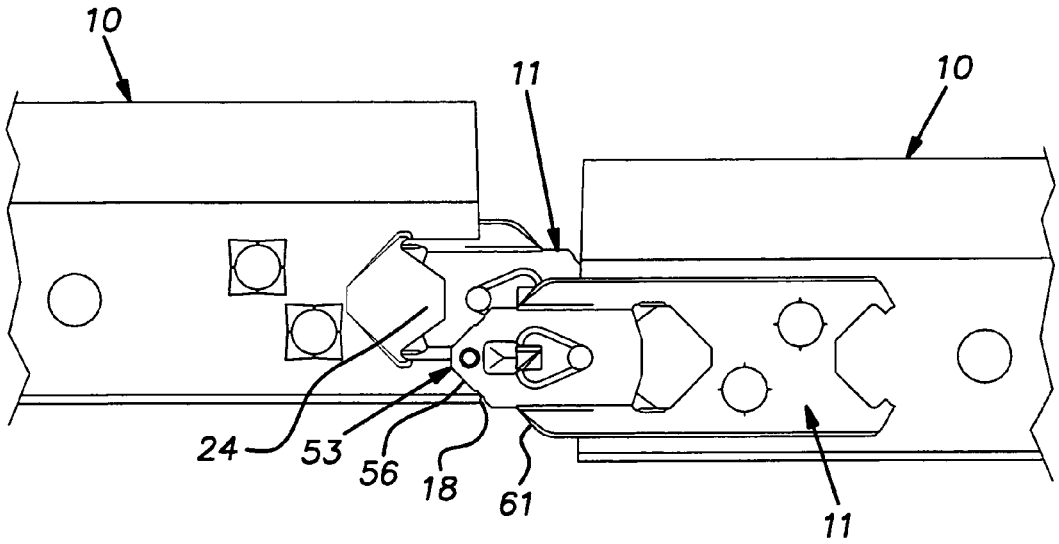
FIG. 11 is a fragmentary side elevational view of two grid runners being assembled with a lead-end portion of one connector clip being guided into vertical registration with an opposing grid runner by contact of the right hand clip with the flange of the left hand grid runner.
Figure 12:
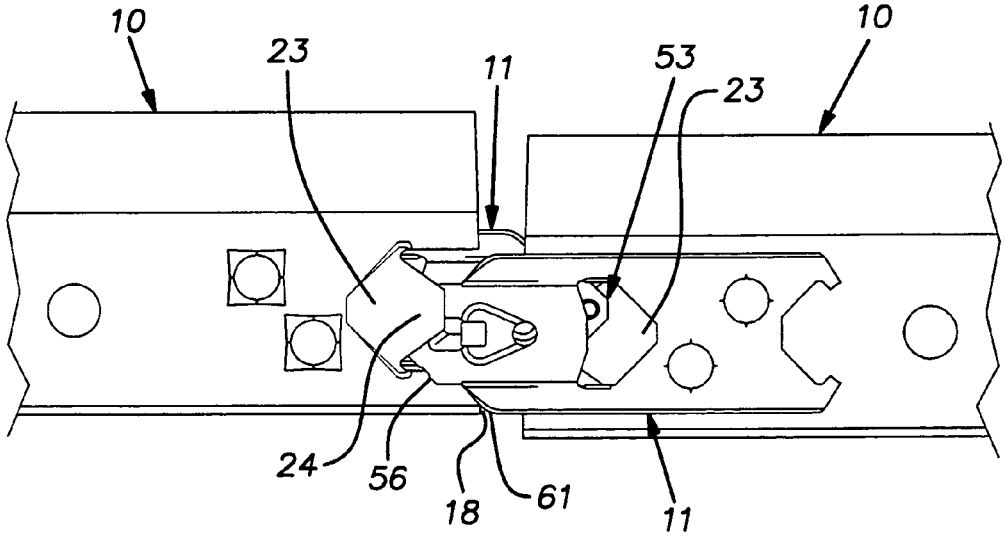
FIG. 12 is a view similar to FIG. 11 with the ends of the runners further advanced towards abutting contact and the right-hand clip still bearing on the flange of the left-hand grid runner to vertically align the grid runners.

The geometry of the clip 11 and formations on the end of the tee 10 are arranged to connect with an identical clip, or a similar clip, and a tee end with features described above in the manner of a handshake. Therefore, as is customary, the tee 10 has identical or essentially the same clips on each of its ends. Tees are connected end-to-end by roughly aligning them end-to-end and pushing their clips into the pockets 66 formed between the inside of the web embossment 23 and the related clip 11 of the opposed tee end. The initial alignment need not be perfect since the tapered nose of the connector formed by the surfaces 56, 57 and 61, 62 is adapted to guide or cam the clips into vertical alignment. Lateral alignment is initially accomplished by simply abutting the clips laterally or side-by-side. If the clip 11 of the tee being installed is simply laid onto the top of the flange portion 16 of the previously installed tee, with the clip abutting the correct side of the clip on the previously installed tee, the lower inclined edges or surfaces 56, 61 of the clip being installed will cam the clip vertically upward when it is pushed longitudinally against the opposing tee. This camming action is depicted in FIGS. 11 and 12 where the surfaces 56 and 61 engage the forward edge of a flange portion 16 of an opposing previously installed tee 10. The spherical projection 52 prevents the lead edge 53 of the clip being forced into a pocket 66 from cutting into the surface of the opposing tab 24 or rearward part of the embossment 23, typically of a softer material than a clip. The angular or oblique orientation of the receiving tab 24 and associated embossment 23, urges the installing clip laterally towards the plane of the web 13 of the receiving tee. Towards the end of the insertion motion, the flanges or tabs 41 of a receiving clip 11 register with the parallel edges 59 of the clip being inserted to closely vertically register the clips together. The converging distance between the flanges 41 avoids any unnecessarily tight fit between the edges 59 of an installing clip and the flanges of a receiving clip until the clips are very nearly fully connected. When the clip being installed is longitudinally fully advanced relative to the receiving clip, the rearwardly facing edge surface or locking edge 51 of the projection 48 snaps into a projection receiving area formed by the major hole 39 of the mating clip and locks against this hole edge 42 forming a rearward facing locking surface. This snap action produces audible and tactile signals to the installer that the connection is completed. Prior to the last increment of assembly motion, the recess or depression 47 can reduce interference between this area and the advancing projection 52 and can assist in vertically aligning the clips by vertically guiding the advancing projection. The tapered profile of the lead edge 53 of the clip, the geometry of the flanges 41 and pocket 66 prevent the mating clips from connecting if the clips, and their runners are vertically misaligned.

The clips 11 can be precisely formed from a sheet metal strip since the stock can be held to exacting thickness tolerances while being reasonably economical due to its relatively small size compared to the volume of material comprising the grid tee proper. The pocket 66 formed between the embossment 23 including the tab 24 and the inside surface of the clip 10 does not vary in width despite regularly experienced variations in the thickness of the tee material stock. Variation in the width of the pocket 66 is avoided because the tab 24 and associated embossment 23 can be readily stamped by tooling with a lateral offset from the plane of the tee web by a fixed predetermined amount regardless of the thickness of the tee material stock. Consistent lateral sizing of the pocket 66 ensures that only a low consistent force is required to establish a full connection between a pair of tees. The connection between abutted tees is quite strong, because the locking surfaces are part of the clips and, therefore, have very high yield strength. With a pair of clips 11 coupled to one another their respective round holes 44 are in alignment and a screw or other fastener can be inserted through these holes where an exceptionally strong joint is required.

A coupled pair of grid tees can be conveniently disconnected without tools by simply twisting one of the coupled tees about its longitudinal axis. This twisting action results in resilient deflection of the tabs 24, embossments 23 and clips to a degree sufficient to enable the locking edges 51 to move laterally out of engagement with the receiving edge 42 of the main hole 39 of the opposing clip to thereby release their locking engagement. This resilient deflection is permitted by the geometry of the related embossment and tab on the web and the absence of direct affixing of the clip to the web forward of the locking edge of the major hole in the web.

The flat angled portion of the clip between the lines 63, 64 at the forward end of the clip that is angled relative to the plane of the clip at the rear acts when connected to another clip to "sandwich" or force the tee web above and below the notched forward web area into planar alignment with another connected tee regardless of the tee material thickness.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A grid runner of predetermined length having a generally planar web and a separately formed clip attached to the web at each end of the runner, the web at each end of the runner having a portion deformed laterally out of the plane of the web, the web portion and the clip at each respective runner end forming a pocket configured to receive a lead portion of an identical clip of a mating runner for connecting said runners together in a direct contact butt-type joint, said clips having directly laterally abutting areas with inter-engaging projections, each projection with a rearward facing locking surface, and projection receiving areas, each receiving area with a rearward facing locking surface, the locking surfaces of the clip engaging the locking surfaces of the identical clip when the runners are abutted end-to-end, said clip being formed of a material substantially harder than the material forming the web.

2. A grid runner of predetermined length having a generally planar web and a separately formed clip attached to the web at each end of the runner, the web at each end of the runner having a portion deformed laterally out of the plane of the web, the web portion and the clip at each respective runner end forming a pocket configured to receive a lead portion of an identical clip of a mating runner for connecting said runners together in a direct contact butt-type joint, said clips having inter-engaging projections, each projection with a rearward facing locking surface, and projection receiving areas, each receiving area with a rearward facing locking surface, said clip being formed of a material substantially harder than the material forming the web, said clip being attached to said runner with integral portions of the clip being displaced from an original plane of the clip material, the integral portions extending through a hole in the web from a first side of the web on which the clip proper is disposed and being clinched on a side of the web opposite said first side, whereby the performance of the clinch is substantially unaffected by the thickness of the web.

3. A grid runner of predetermined length having a generally planar web and a separately formed clip attached to the web at each end of the runner, the web at each end of the runner having a portion deformed laterally out of the plane of the web, the web portion and the clip at each respective runner end forming a pocket configured to receive a lead portion of an identical clip of a mating runner for connecting said runners together in a direct contact butt-type joint, said clips having inter-engaging projections, each projection with a rearward facing locking surface, and projection receiving areas, each receiving area with a rearward facing locking surface, said clip being formed of a material substantially harder than the material forming the web, the web being notched forward of the pocket such that all of the web material forward of the locking surface of the clip and in the path of the locking projection of the identical clip to be connected is eliminated.

4. A grid runner of predetermined length having a generally planar web and a separately formed clip attached to the web at each end of the runner, the web at each end of the runner having a portion deformed laterally out of the plane of the web, the clip at each respective runner end being configured to couple with a lead portion of an identical clip of a mating runner for connecting said runners together in a direct contact butt type joint, inter-engaging projections, each projection with a rearward facing locking surface, and projection receiving areas, each receiving area with a rearward facing locking surface, at each end of the runner for effecting said runner connecting function, the projections being formed on said clips, each clip abutting an associated web along a generally planar zone that extends longitudinally and laterally along the web, the projection of each clip being located at a generally central region of the lateral extent of the zone, the attachment of the clip to the web and the configuration of the web portion and clip affording sufficient local resilient deformation of the clip and web portion when one of a pair of joined runners is twisted about its longitudinal axis relative to the other runner to enable the connected clips to disengage by causing the projection to move away from said zone and out of inter-engagement with the projection receiving area of the other connected clip.

5. A grid runner as set forth in claim 4, wherein the projection on a clip extends in a lateral direction parallel to the planar zone a relatively small distance compared to the extent that the clip extends laterally along said planar zone.

6. A grid runner as set forth in claim 5, wherein each clip is attached to a respective end area of a runner exclusively at locations rearward of the associated projection receiving area.

7. A grid runner of predetermined length having a generally planar web and a separately formed clip attached to the web at each end of the runner, the material of the clip being substantially harder than the material of the web, the clip being configured to receive a lead end portion of an identical clip of a mating runner for connecting said runners together in a direct contact butt-type joint, said clips having inter-engaging projections, each projection with a rearward facing locking surface, and projection receiving areas, each receiving area with a rearward facing locking surface, wherein the locking surfaces of the clip engage locking surfaces of an identical clip when adjacent runners with identical clips attached thereto are abutted end-to-end.

8. A grid runner as set forth in claim 7, said clip having a through hole centered about an imaginary plane that is transverse to the longitudinal direction of the runner and passes through the end of the runner whereby when the clip is connected to an identical clip, a fastener can be assembled through said hole and a corresponding hole in the identical clip to obtain a supplemental strong interconnection between said runners.

9. A grid runner of predetermined length having a generally planar web and a separately formed clip attached to the web at each end of the runner, the clip being configured to receive a lead portion of an identical clip of a mating runner for connecting said runners together in a direct contact butt-type joint, inter-engaging projections, each projection with a rearward facing locking surface, and projection receiving areas, each receiving area with a rearward facing locking surface, that directly engage one another when a pair of clips are joined, said clips being attached to said runner with integral portions of the clip being displaced from an original plane of the clip material, the integral portions extending through a hole in the web from a first side of the web on which the clip proper is disposed and being clinched on a side of the web opposite said first side, whereby the performance of the clip is substantially unaffected by the thickness of the web.

10. A grid runner as set forth in claim 9, wherein the clip is formed of a material substantially harder than the material forming the web.

11. A grid runner of predetermined length having a generally planar web and a separately formed clip attached to the web at each end of the runner, the clip being configured to receive a lead portion of an identical clip of a mating runner for connecting said runners together in a direct contact butt-type joint, said clips having inter-engaging projections, each projection with a rearward facing locking surface, and projection receiving areas, each receiving area with a rearward facing locking surface, a generally planar part of the body of the clip generally forward of the projection receiving area being bent about an axis transverse to the lengthwise direction of the clip at an area adjacent the projection receiving area, laterally in the direction the associated projection projects, slightly relative to a generally planar part of the body of the clip rearward of the projection receiving zone whereby abutting joined tees are forced into planar alignment when associated clips are coupled together and said forward planar body parts of each of the coupled clips engage adjacent parts of the other clip.

12. A grid runner of predetermined length having a generally planar web and a separately formed clip attached to the web at each end of the runner, the clip being configured to receive a lead portion of an identical clip of a mating runner for connecting said runners together in a direct contact butt-type joint, inter-engaging projections, each projection with a rearward facing locking surface, and projection receiving areas, each receiving area with a rearward facing locking surface, said clip having a pair of opposed alignment tabs spaced apart from one another a predetermined distance, the clip having a body portion sized to closely fit between the opposed tabs of an identical clip whereby said tabs and closely sized body portion of the identical clip of a second runner vertically register the grid runners to one another when the clip and the identical clip are properly positioned relative to each other side by side and making a connection of said runners.

13. A grid runner as set forth in claim 12, wherein said tabs extend through the plane of said web.

14. A grid runner as set forth in claim 13, wherein said tabs diverge from one another in a vertical dimension with increasing distance from said clip whereby said identical clip is increasingly confined vertically between said tabs as said identical clip moves laterally between said tabs towards said clip.

* * * * *